US007255299B2

(12) United States Patent
Braun

(10) Patent No.: US 7,255,299 B2
(45) Date of Patent: Aug. 14, 2007

(54) FABRIC STORAGE PANEL

(76) Inventor: Elaine A. Braun, P.O. Box 211145, Auke Bay, AK (US) 99821

( * ) Notice: Subject to any disclaimer, the term of this patent is extended or adjusted under 35 U.S.C. 154(b) by 349 days.

(21) Appl. No.: 10/921,165

(22) Filed: Aug. 19, 2004

(65) Prior Publication Data

US 2006/0038055 A1 Feb. 23, 2006

(51) Int. Cl.
*B65H 75/38* (2006.01)

(52) U.S. Cl. ..... 242/405.1; 242/400.1; 242/402; 242/613.3

(58) Field of Classification Search ..... 242/405.1, 242/400.1, 402, 610.1, 222, 586, 586.4–586.6, 242/613, 613.3, 613.5, 610.6, 588, 118, 407, 242/570

See application file for complete search history.

(56) References Cited

U.S. PATENT DOCUMENTS

| | | | | |
|---|---|---|---|---|
| 1,005,787 | A | | 10/1911 | Sibley |
| 1,012,267 | A | | 12/1911 | Motz |
| 1,659,282 | A | | 2/1928 | Scheffey |
| 1,910,589 | A | | 5/1933 | Butler |
| 2,028,396 | A | | 1/1936 | King |
| 3,286,825 | A | | 11/1966 | Yovanovich |
| 3,682,816 | A | | 8/1972 | Yovanovich |
| 3,763,999 | A | | 10/1973 | Yovanovich |
| 3,768,640 | A | | 10/1973 | Piscatelli |
| 3,780,855 | A | | 12/1973 | McLeod et al. |
| 3,967,800 | A | | 7/1976 | Firstenberg et al. |
| 4,126,285 | A | | 11/1978 | Spruill |
| 4,161,075 | A | * | 7/1979 | Eubanks et al. ..... 40/309 |
| 4,258,843 | A | * | 3/1981 | Wymer ..... 206/63.3 |
| 5,335,872 | A | | 8/1994 | Clubbs |
| 5,535,961 | A | | 7/1996 | Duckworth et al. |
| 5,676,249 | A | * | 10/1997 | DeProspero ..... 206/388 |
| 6,023,872 | A | * | 2/2000 | Falkenstein, Sr. ..... 40/800 |
| 6,383,590 | B1 | | 5/2002 | Kao |

FOREIGN PATENT DOCUMENTS

| | | | |
|---|---|---|---|
| DE | 4221574 A1 | * | 1/1994 |
| GB | 1117540 | | 6/1968 |
| GB | 1277687 | | 6/1972 |
| WO | WO9316947 | * | 3/1993 |

* cited by examiner

*Primary Examiner*—Gene O. Crawford
*Assistant Examiner*—Sang Kim
(74) *Attorney, Agent, or Firm*—Richard C. Litman

(57) ABSTRACT

The fabric storage panel is a relatively small, thin, plastic plate particularly configured for the long term storage of relatively small lengths of fabric for home or similar occasional use. The plastic material is essentially chemically inert to fabric stored thereon, thereby precluding damage to fabric or its dyes from acid as found in conventional cardboard fabric storage boards. The present panel may be formed as a single plate of solid plastic, or may comprise multiple cross laminations of corrugated plastic sheet material. Tabs or clips grip the edge of a fabric sheet placed therein to facilitate initiation of the fabric winding process thereon. A hole or grommet may be provided in at least one end of the panel for hanging the panel for storage.

15 Claims, 3 Drawing Sheets

FABRIC STORAGE PANEL

BACKGROUND OF THE INVENTION

1. Field of the Invention

The present invention relates generally to storage systems and devices, and more specifically to a relatively thin, flat panel configured for winding and storing a sheet of fabric material or the like thereon.

2. Description of the Related Art

Many persons who work with fabric as a hobby or as a small business have need to purchase and store relatively large numbers of relatively small sheets of fabric for future use. While this may be true of those who sew articles of clothing, it is particularly true of those engaged in quilting, where a relatively large number of fabric pieces, each having a relatively small area, are joined together to form the completed object.

Quilters often purchase relatively small quantities of fabric, e.g., one or two yards each of various types, prints, or patterns, when visiting a fabric store. The fabric is often set aside in storage for perhaps a considerable length of time until the quilter comes across a pattern or project for which the stored fabric would be appropriate. The storage and convenient access of such fabric in the home sewing room can be a problem, particularly if a large number of relatively small quantities of fabrics have been purchased and stored over a few years or so. Relatively small fabric sheets are often stacked atop one another in a closet or similar area until the sewer or quilter wishes to use a certain type or pattern. It can be difficult to access a specific sheet of fabric from perhaps dozens stacked atop one another, with any previous arrangement of such fabrics falling into disarray as the search for a given sheet of fabric continues.

Various impromptu solutions for the problem of fabric storage have been attempted in the past. An apparently obvious solution for the problem is to use essentially the same storage system as used in the fabric store, i.e., wind the fabric onto a relatively large and thick cardboard sheet or tube of some sort. Upon consideration, this is not at all suitable for the storage of a large number of sheets of fabric, each having a relatively small size. The size of the cores from which fabric is sold in stores, would take up more room than the small quantities of fabric wound upon the rolls or cores.

Perhaps more importantly, the fabric storage rolls or cores used in fabric stores are almost universally formed of cardboard. Cardboard and other paper includes some acid therein, due to the wood pulp from which it is made and as a result of the manufacturing process. The only exception is acid free paper, which is relatively costly and only used for very specialized purposes, e.g., backing for the display of photographs, very high quality books and the like, etc. The acids in the typical fabric storage core result in damage to the fabric stored thereon if the fabric remains on the roll or core for an extended period of time. This is not ordinarily a problem in the typical fabric store, where a bolt containing fifteen linear yards or so of fabric is generally completely sold within a few months or so. However, discoloration of the dyes or damage to the fabric itself is a likely occurrence when fabrics are stored upon conventional cardboard cores for an extended period of time.

The present invention provides a solution to the above problem, with a relatively small plastic panel particularly configured for holding and storing a relatively small quantity of fabric thereon without damage to the fabric during long term storage. The present storage panel may be formed of various types of plastic having various structures, and preferably includes means for gripping one edge of the fabric to start the winding process on the panel.

A discussion of the related art of which the present inventor is aware, and its differences and distinctions from the present invention, is provided below.

U.S. Pat. No. 1,005,787 issued on Oct. 10, 1911 to George H. Sibley, titled "Fabric Package," describes a core for rolling fabric thereon, the core comprising a cylinder of corrugated cardboard material with the corrugations exposed on the outer surface thereof. The single face sheet of the corrugated material allows the material to be flattened readily, and expanded to cylindrical form by the insertion of a solid rod therein. The external corrugations also assist in securing the fabric to the core.

U.S. Pat. No. 1,012,267 issued on Dec. 19, 1911 to Frederick J. Motz, titled "Textile Board," describes a built-up structure formed of some form of fiberboard (i.e., cardboard). The Motz board is relatively thick, as he uses a series of cardboard ribs or spacers between the two opposed face sheets of his board. Other than the Motz board being a reasonably rigid structure, the same points noted above in the discussion of the Sibley fabric storage device are seen to apply here as well.

U.S. Pat. No. 1,659,282 issued on Feb. 14, 1928 to George B. Scheffey, titled "Cloth Board Or Similar Article," describes a board having a single ply of corrugated material covered by a face sheet over both sides thereof. The corrugations are aligned across the width of the board, rather than its length. This provides reasonable stiffness across the width of the board, but somewhat greater lengthwise flexibility is allowed with this configuration. In any event, Scheffey also specifies the use of paper materials (cardboard, etc.) for his board, which opens the door for the possibility of fabric damage, as has been noted further above.

U.S. Pat. No. 1,910,589 issued on May 23, 1933 to Chalmers M. Butler, titled "Cloth Board," describes another board formed of stiff paper, i.e., cardboard or the like. Butler does not disclose the use of corrugated material, but he does add a rounded, slotted tubular edge along two opposed sides of the device in order to better secure the laminations of the board together.

U.S. Pat. No. 2,028,396 issued on Jan. 21, 1936 to Edward F. King, titled "Cloth Board," describes a built-up board structure having opposed rounded edges formed of sheet metal with a series of transverse ribs therebetween. A cloth or paper cover is adhesively attached to the ends of the frame, with a tautening coating applied to the cover to cause the cover to shrink somewhat to provide a taut surface. It would appear that even if fabric were used as the cover for the King structure, the coating materials applied thereto could affect untreated fabric wrapped thereon.

U.S. Pat. No. 3,286,828 issued on Nov. 22, 1966 to Joseph T. Yovanovich, titled "Cloth-Board Reel," describes a built-up structure having two laminations of corrugated cardboard material. This structure is covered with a paper wrap. The only material disclosed by Yovanovich for his cloth reel is paper or cardboard. U.S. Pat. No. 3,682,816 issued on Aug. 8, 1972 also to Joseph T. Yovanovich, titled "Cloth-Board Reel," describes a board having a similar external shape to that of the device of the '828 patent. The core of the '816 board differs in that it is formed of foam plastic material.

U.S. Pat. No. 3,763,999 issued on Oct. 9, 1973 to Joseph T. Yovanovich, titled "Cloth-Board Reel," is a continuation-in-part of the '816 patent. The reel of the '999 U.S. Patent differs from the reel of the '816 U.S. Patent by having a discontinuous paper cover which does not extend around the semicylindrical edges of the board or reel. However, the majority of the surface is still covered with paper, with the disadvantages of such having been noted further above.

U.S. Pat. No. 3,768,640 issued on Oct. 30, 1973 to Andrew Piscatelli, titled "Novel Cloth Winding Board," describes a process for molding a board of expanded polystyrene, i.e., Styrofoam®. Piscatelli recognizes the desirability of using a non-acidic material for a fabric winding board. However, his board is relatively thick in order to provide the necessary structural strength required of such relatively lightweight material. Moreover, Piscatelli does not disclose any means of anchoring the initial end of an elongate strip of fabric to his board to initiate the winding process.

U.S. Pat. No. 3,780,855 issued on Dec. 25, 1973 to John W. McLeod et al., titled "Winding Board," describes a board formed of a sheet of corrugated cardboard which is folded to provide a hollow core construction having a substantially greater thickness than would be the case with two back-to-back sheets. McLeod et al. also cut through the outer sheet of the corrugated panel along certain fold lines. This facilitates folding of the corrugated sheet, and also exposes an edge of the panel to provide a better grip for the fabric as it is placed upon the panel.

U.S. Pat. No. 3,967,800 issued on Jul. 6, 1976 to Morris Firstenberg et al., titled "Cloth-Board Reel," describes a board formed of two cross-laminated corrugations of corrugated cardboard material. The conventional flat overlay sheet normally applied to each side of each corrugation has been eliminated in the Firstenberg et al. reel, with only a single wrap of paper material surrounding the two corrugated laminates. The problems with such a paper external cover, with the acids normally found in such paper, have been noted further above.

U.S. Pat. No. 4,126,285 issued on Nov. 21, 1978 to Robert E. Spruill, titled "Winding Reel," describes another flat, box-like structure formed of a single folded sheet of corrugated cardboard. The device is more closely related to the folded corrugated cardboard device of the McLeod et al. '855 U.S. Patent discussed further above, than it is to the present invention.

U.S. Pat. No. 4,161,075 issued on Jul. 17, 1979 to Ann E. Eubanks et al., titled "Thread And Yarn Organizer," describes a relatively small, flat sheet of material having a reduced width across its midsection for winding yarn or the like thereon. The reduced midsection of the Eubanks et al. device is required to preclude slippage of the strands from one end or the other of the device.

U.S. Pat. No. 5,335,872 issued on Aug. 9, 1994 to William R. Clubbs, titled "Protective Core," describes a plastic panel or board formed of two relatively thin outer sheets with a series of webs or ribs joining the two outer sheets together, somewhat like corrugated material. The outer sheets are creased to facilitate folding and forming the panel as desired. Clubbs states that his panel or board is relatively flexible to allow it to be easily formed into a cylinder for use as a core in a roll of material.

U.S. Pat. No. 5,535,961 issued on Jul. 16, 1996 to Marty J. Duckworth et al., titled "Fabric Shell," describes a relatively large and heavy cylindrical device for holding a length of heavy fabric thereon for use in tire manufacture. The device is formed of plastic with a square section steel tube axle.

U.S. Pat. No. 6,383,590 issued on May 7, 2002 to Cheng-Kang Kao, titled "Tear-Along Structure Of A Sheet Material," describes the wrapping or rolling of a thin sheet of material having characteristics allowing it to be torn easily in only one direction. The material is wrapped about a core formed of one or more flat panels, and slit at the edges of the core panels. Kao does not disclose any specifics for the panel(s) used for the core of his sheet material wrap.

British Patent No. 1,117,540, published on Jun. 19, 1968, titled "Cloth-Board Reel," appears to be related to the '828 U.S. Patent to Yovanovich, discussed further above. The drawings of the '828 U.S. Patent and the '520 British Patent Publication are identical to one another.

Finally, British Patent No. 1,277,687, published on Jun. 14, 1972, titled "Cloth-Boards," describes a frame formed of tubular components and having flat end members. The structure is covered with a paper covering. The disadvantages of using paper as the contact surface for the long term storage of fabric, have been noted further above None of the above inventions and patents, taken either singly or in combination, is seen to describe the instant invention as claimed. Thus, a fabric storage panel solving the aforementioned problems is desired.

SUMMARY OF THE INVENTION

The present fabric storage panel essentially comprises a relatively small, thin, plastic panel or plate configured for the winding or rolling of an elongate sheet of fabric material thereon. The chemically inert plastic material cannot react chemically with dyes or with the fabric material stored thereon, thereby providing safe storage for fabric stored thereon for an extended period of time. Different embodiments may comprise a solid panel, or a composite panel formed of a pair of corrugated panels with their corrugations being at angles to one another to provide the desired rigidity in all directions. The panel preferably has sufficient stiffness that the panel does not curl.

The present fabric storage panel is preferably on the order of eleven and one-half inches long, i.e., in the axial direction of fabric wound thereon. Thus, fabric from a conventional bolt of material having a width of about forty-four inches or so may be folded lengthwise two times (four thicknesses) to provide a width somewhat less than the present storage panel. Alternatively a quarter yard of fabric, or a half yard folded once, etc., may be wrapped about the present storage panel with the width of the bolt wrapping around the shorter dimension of the panel and the nine inch width of the quarter yard or folded longer length extending between the two ends of the panel.

The fabric storage panel also include means for securing one end of a length of fabric material thereto to facilitate the initiation of the winding process. The securing means preferably comprises one or more (preferably two) narrow partially cutout tabs in the panel material, with the relatively narrow attachments across the ends of the tabs providing the required flexibility and resilience for the tabs to be displaced from their coplanar disposition in the panel and to resiliently grip the edge of the fabric between the tabs and the adjacent panel surface. However, other embodiments of the present invention may include other means for securing the end of the fabric material thereto, such as a discrete resilient clip attached to the panel.

Some embodiments of the fabric storage panel also include a hole or grommet at one end thereof for hanging the panel on a vertical surface or the like for storage.

These and other features of the present invention will be readily apparent upon consideration of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention comprises various embodiments of a relatively small and lightweight fabric storage panel, configured particularly for home and hobby use for the storage of a relatively small amount of fabric thereon. The present fabric storage panel is well suited for use by home and amateur fabric workers who may have a relatively large number of small portions of fabric on hand for various projects, and who need a neat and efficient means of storing such fabric until a need for its use arises.

Figure 1:
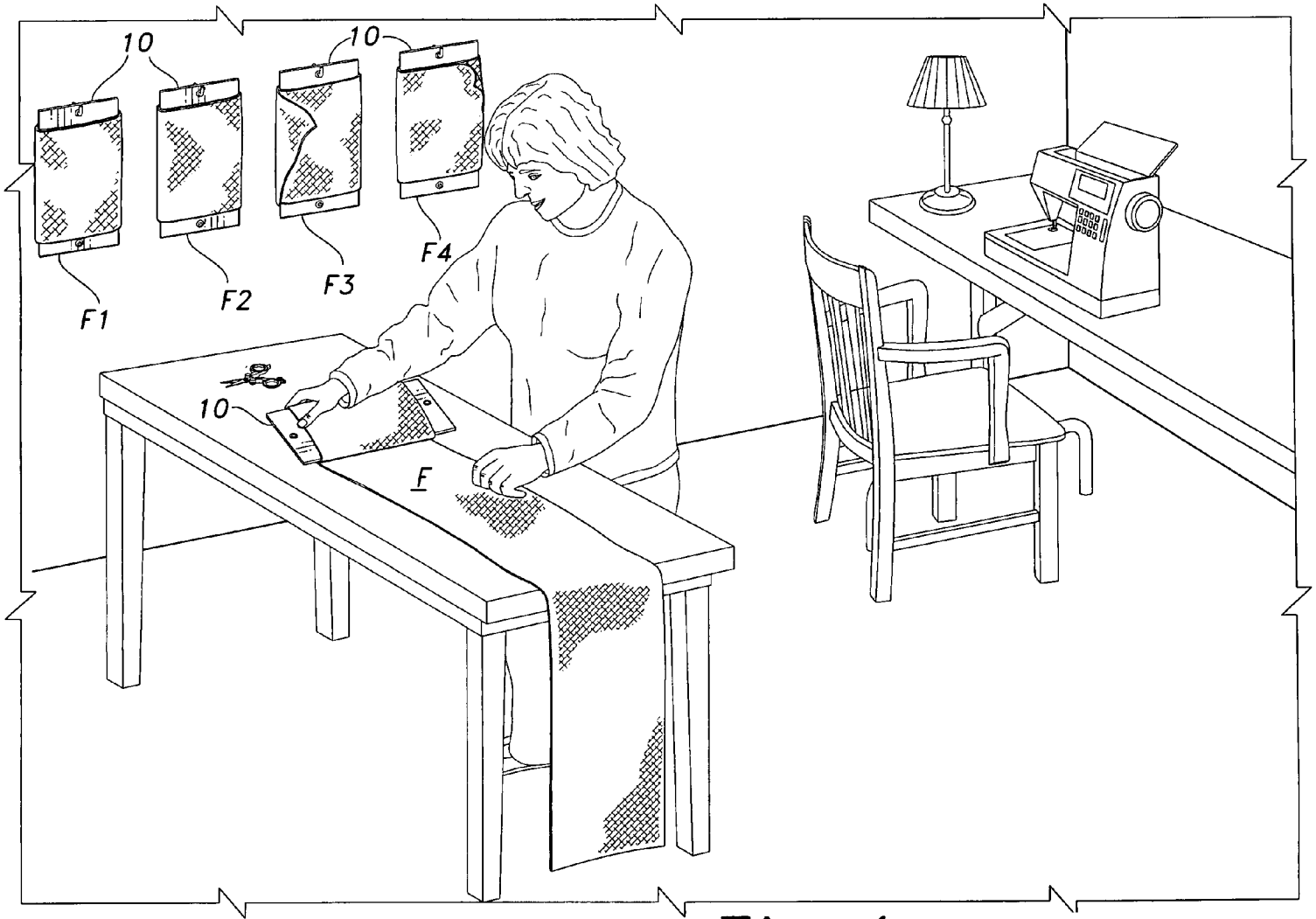
FIG. 1 is an environmental, perspective view of a fabric storage panel according to the present invention having a length of fabric wound thereon, with additional panels having fabric thereon being shown in the background.
Figure 2:
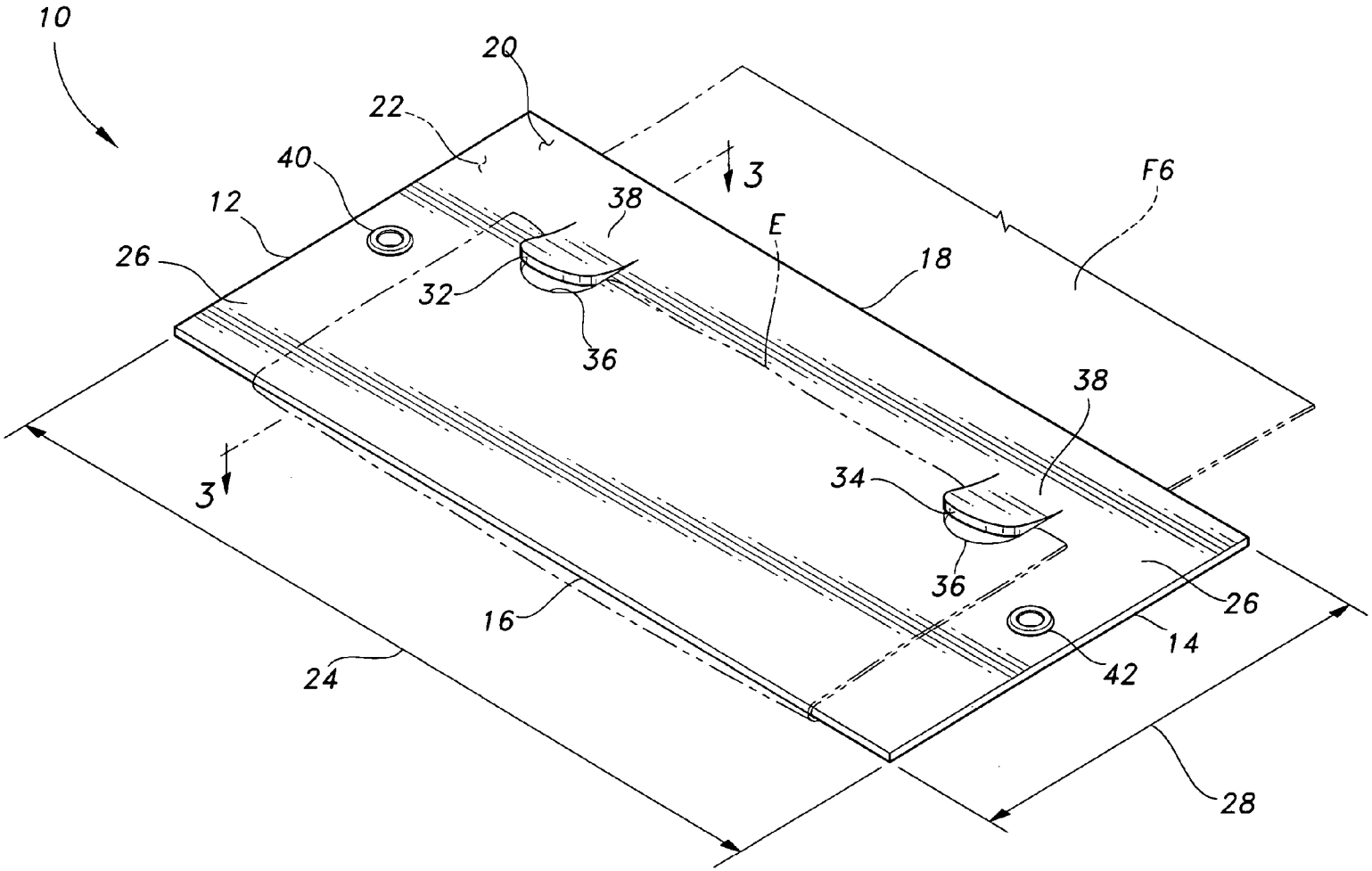
FIG. 2 is a perspective view of a single first embodiment panel of the present invention, showing the initiation of the winding of a length of fabric material thereon.
Figure 3:
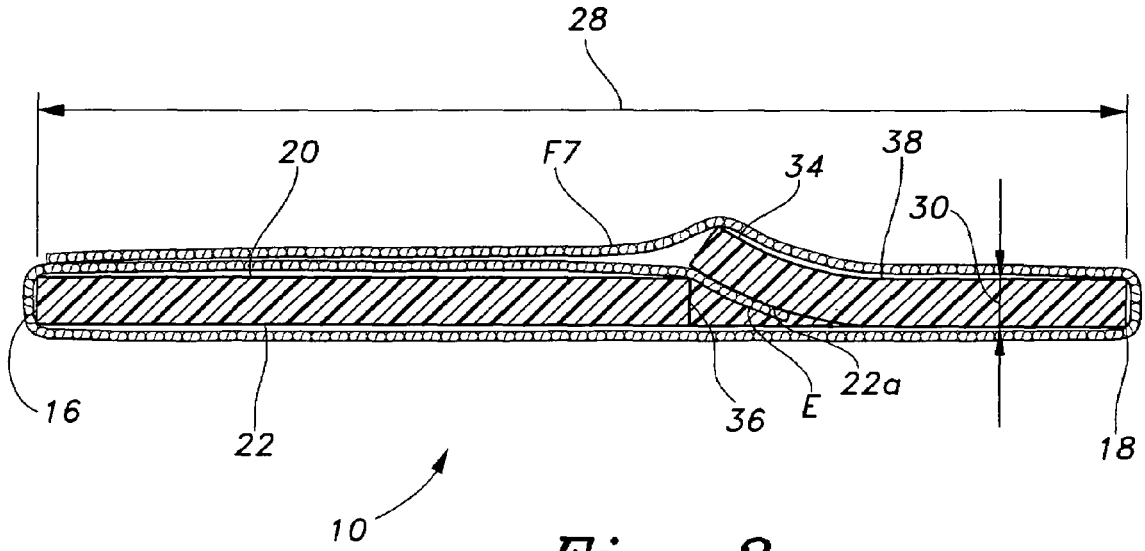
FIG. 3 is an end elevation view in section of the first embodiment of the present panel, showing the bending of one tab to grip the edge of a fabric panel therein.

FIG. 1 of the drawings provides an environmental perspective view of a first embodiment 10 of the present fabric storage panel being used for wrapping a length of fabric F thereon, with a series of fabric storage panels 10 having other lengths of fabric F1 through F4 wound and stored thereon. FIGS. 2 and 3 provide perspective and end elevation views, respectively, of the first embodiment fabric storage panel 10, with attention being directed to FIGS. 2 and 3 for the following explanation of the first embodiment of the present invention.

The fabric storage panel 10 comprises a relatively small, thin, plastic plate having opposite ends 12 and 14, opposite straight edges 16 and 18, and opposite parallel surfaces 20 and 22 (FIG. 3). The panel 10 is preferably flat, and is made from a material having sufficient stiffness that the panel 10 does not curl. The two opposite ends 12 and 14 define a length 24 therebetween of about eleven and one-half inches, although this length 24 may be adjusted as desired. Eleven and one-half inches has been found to work well, as the typical bolt of fabric in a yard goods store or the like has a width on the order of forty-two to forty-four inches. A length of fabric cut from such a bolt may be folded over twice, i.e., to form four layers, having a folded width of no more than eleven inches. This leaves a short end portion 26 extending from either or both sides of the fabric, to enable the storage panel 10 to be hung for storage, if desired, as explained-further below.

The opposite edges 16 and 18 of the fabric storage panel 10 define a width 28 therebetween of about seven and one-half inches, although the width 28 may be adjusted as desired. The two opposite surfaces 20 and 22 define a thickness 30 of about one-eighth of an inch; the thickness 30 is exaggerated in FIG. 3 for clarity in the drawing. As in the case of the other dimensions, the thickness 30 may be adjusted as desired. However, a thickness 30 of about one-eighth inch is sufficient to provide the desired stiffness for the panel 10 when it is formed of a solid, monolithic sheet of low to high density polyethylene or other plastic material, as desired, and provides a compact profile for storage of multiple fabric storage panels. The fabric stored thereon is not wound tightly, in order to avoid creasing or stretching the fabric. Thus, no significant compression is applied across the width 28 of the panel 10 by fabric stored thereon.

The embodiment of the fabric storage panel 10 shown in the drawings further includes a pair of laterally spaced fabric sheet gripping tabs 32 and 34 formed therein. (A single tab may be provided if so desired, but two laterally spaced tabs are preferred, in order to secure the edge of the fabric sheet F6, F7, etc. near both corners thereof. Additional tabs may be provided if so desired.) In the case of the monolithic fabric storage panel or plate 10 of FIGS. 1 through 3, the tabs 32 and 34 are cut or punched to have a partial periphery 36 which extends completely through the panel 10. The cutout 36 does not completely surround the tabs 32 and 34, with each tab 32 and 34 being connected to the remainder of the panel 10 by a resilient attachment portion 38 which integrally and monolithically connects each tab 32 and 34 to the remainder of the plate or panel 10 and acts as a resilient and flexible hinge for each tab 32 and 34. While the plastic panel or plate 10 has sufficient stiffness or rigidity that the panel 10 does not curl, it will be understood that the plastic material has sufficient flexibility and resilience that the tabs 32 and 34 can be pushed or pulled to flex out of the plane of the panel 10 to grip the initial edge E of the fabric stored thereon. As the ends of the tab cutouts 36 lie along the same axis parallel to the panel or plate edges 16 and 18, the base 38 will define hinge axes parallel to the axial length 24 of the panel or plate 10 and thus closely parallel to the starting edge E of the fabric, e.g., fabric sheet F6, to be wound and stored thereon. Alternatively, resilient clips may be attached to the panel 10 to grip the edge of the fabric sheet F6 or F7.

The present fabric storage panel 10 is configured for efficient storage, either as an empty panel or with fabric stored thereon. The panels 10 may be stored upright on a storage shelf, the thinness of the panels 10 permitting compact storage. Alternatively, at least one end of the panel 10 may include a storage hanger therein, and preferably each of the two ends 12 and 14 includes a hanger hole and grommet, respectively 40 and 42, installed therein. The hole and grommet 40 or 42 permit the panel 10 to be hung on a storage hook or the like along the wall of a closet, sewing room, or other area as desired. Alternatively, other storage means may be provided for the panel 10, e.g., a hook or the like extending from one or both ends of the panel for removable insertion in a corresponding hole in a storage surface (wall panel, etc.), or perhaps a removable clip attached to one end of the panel for hanging from a hook or the like, etc.

Figure 4:
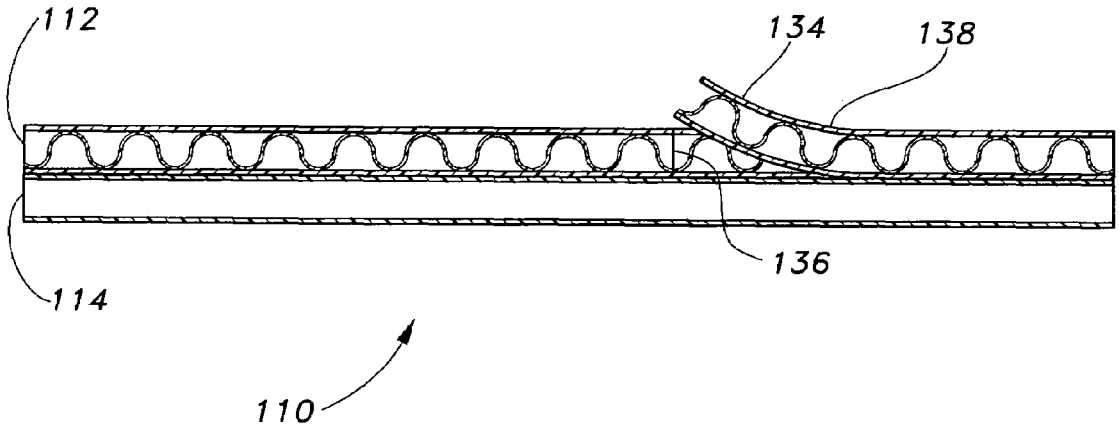
FIG. 4 is an end elevation view in section of an alternative fabric storage panel formed of two cross-laminated sheets of corrugated plastic material.

FIG. 4 of the drawings provides an end elevation view in section similar to the orientation of the view of FIG. 3, but for a different fabric storage panel embodiment 110. The panel or plate 110 is preferably formed to have essentially the same dimensions as the panel or plate 10 of FIGS. 1 through 3, but is formed of different materials. Rather than being formed of a single, monolithic sheet of plastic material, the panel 110 is formed of a plurality of laminations of corrugated plastic material. The exemplary fabric storage panel 110 of FIG. 3 is formed of two plies or laminations 112 and 114 of corrugated plastic material, with the corrugations of the two plies 112 and 114 being at an angle to one another. It is well known that corrugated material is stiffer across the direction of the corrugations than parallel to the corrugations, and thus laminating the two plies 112 and 114 at an angle to one another provides good stiffness for both the length and the width of the panel 110. The orientation of the corrugations of the two plies may be at 90 degrees to one another, or at some smaller angle as desired.

The fabric storage panel 110 of FIG. 3 also includes at least one (and preferably two) fabric sheet gripping tabs, e.g., the tab 134 shown in FIG. 3. The partial peripheral cut 136 is formed only through a single one of the laminations of the panel 110, and oriented so that the axis of the tab attachment portion 138 is oriented parallel to the corrugations of the layer in which the tab 134 is cut in order to allow the tab 134 to flex outwardly from the plane of the lamination in which it is formed.

FIGS. 1 through 3 of the drawings show how the present fabric storage panel or plate 10 (or 110) is used for the storage of fabric thereon. Fabric, e.g., any of the fabric sheets F, F1, etc., is initially folded as required to have a width at least slightly less than the length 24 of the panel 10 (or other panel embodiment). As most bolts of fabric have widths on the order of about forty-two to forty-four inches, a length of fabric cut from such a bolt would have a width of about ten and one half to eleven inches when folded twice (i.e., four thicknesses) in a lengthwise orientation. This provides for just enough of the end of the panel to extend from the width of the folded fabric for the hanging grommet (or other hanging means) to be exposed when the fabric is rolled onto the panel 10 or 110, generally as shown in FIG. 2 of the drawings. Alternatively, a partial yard of fabric cut from a standard width bolt may be folded from end to end as required and wound upon the storage panel with its bolt width extending around the panel. A quarter yard of fabric, i.e., nine inches in width, would not require folding for such storage, while a half yard would require only a single fold across the width of the bolt to reduce the folded width to nine inches for winding upon the present storage panel.

When the fabric has been folded to have a width suitable for storage upon the present panel, the fabric sheet gripping tabs 32 and 34 are lifted clear of their normal coplanar disposition within the panel 10, and a starting end E of the fabric sheet (at least one ply, when the fabric has been folded) is inserted in the grip tab periphery 36. The resilience of the tabs 32 and 34 grips the end E of the fabric between the raised second surface 22*a* of the tabs 32 and 34 and the opposite first surface 20 of the panel 10. While the force applied by the tabs 32 and 34 is sufficient to hold the end or edge E of the fabric lightly in place as the winding process is initiated, it is not so strong as to damage or stretch the fabric.

Once the fabric end has been secured to the panel by the tabs 32 and 34, the fabric may be wound or rolled onto the panel 10 (or its other embodiments) generally as shown in FIG. 1 of the drawings. When the fabric has been completely wound upon the panel 10, the outer end of the fabric may be pinned or otherwise secured to the remainder of the fabric on the panel and the panel 10 and fabric stored thereon may be placed on a storage shelf or hung upon a suitable surface for convenient and efficient storage by means of the hanging grommet 40 or 42 or other means, generally as shown by the panels 10 and their stored fabric sheets F1 through F4 in FIG. 1.

In conclusion, the present fabric storage panel in its various embodiments provides a much improved means for storing relatively small lengths and portions of fabric for home or amateur use. The plastic material of which the present panels are formed do not react chemically with the dyes and materials of fabrics stored thereon, as do conventional cardboard and paper cores used for storing bolts of fabric in a yard goods store or the like. While this is not generally a problem for such stores, which generally sell their wares relatively quickly, the home sewer or quilter may have lengths of fabric on hand for up to several years before use. The present plastic fabric storage panel eliminates any concern of damage to fabric stored thereon for long term storage.

The size of the present fabric storage panels in their various embodiments provides for convenient storage, whether empty or with fabric stored thereon. The provision of a fabric end grip tab, or other fabric holding means, which may be extended resiliently from the plane of the panel or plate, greatly facilitates the handling of the fabric as the winding operation is initiated. Finally, the optional provision of one or more hanging grommets, hooks, or other means enables the user of the present fabric storage panel to place the panel with the fabric stored thereon in a convenient and readily accessible location for future access as desired. The result is a device which will be much appreciated by the amateur and home sewer and/or quilter who has need for long term storage of relatively small portions of fabric.

It is to be understood that the present invention is not limited to the embodiments described above, but encompasses any and all embodiments within the scope of the following claims.

I claim:

1. A fabric storage panel, comprising:

an elongate, thin plastic plate having a first end and a second end opposite the first end defining an axial length therebetween;

a pair of sides having edges parallel to the axial length; and a plurality of laterally spaced fabric sheet gripping tabs disposed along the axial length;

said tabs for gripping a leading edge of a sheet of fabric parallel to the axial length of the panel so that the fabric may be wrapped around the axial length of the panel for storage.

2. The fabric storage panel according to claim 1, wherein each of said tabs have a partial periphery cut at least partially through said plastic plate, the tab being integrally and monolithically formed from said plastic plate, each said tab is flexible and resilient such as to grip the fabric.

3. The fabric storage panel according to claim 2, wherein:

said plate is a solid, monolithic component; and the partial periphery of each of said tabs is cut completely therethrough.

4. The fabric storage panel according to claim 2, wherein:

said plate comprises multiple cross-ply laminations of corrugated plastic material; and the partial periphery of each of said tabs is cut through a single one of the laminations of corrugated plastic material.

5. The fabric storage panel according to claim 1, wherein said plate has a storage hanger aperture defined therein adjacent one of the ends.

6. The fabric storage panel according to claim 5, further comprising a grommet disposed about the storage hanger aperture.

7. The fabric storage panel according to claim 1, wherein said plate has a length of about eleven and one-half inches and a width of about seven and one-half inches.

8. The fabric storage panel according to claim 1, wherein said plate has a thickness of about one-eighth of an inch.

9. A method of storing a sheet of fabric material on the fabric storage panel of claim 1, comprising the steps of:

(a) folding the sheet of fabric material lengthwise as required to have a width no greater than a width of the plate;

(b) removably gripping one end of the folded sheet of fabric material to the plate; and (c) winding the folded sheet of fabric material about the width of the plate until the fabric material has been completely wound about the plate.

10. The fabric storage panel according to claim 9, wherein:

said plate comprises two cross-ply laminations of corrugated plastic material; and each of said tabs has a partial periphery cut partially through a single one of the laminations, each of said tabs being integrally and monolithically formed from said plastic plate, each of said tabs is flexible and resilient such as to grip the fabric.

11. The fabric storage panel according to claim 9, wherein said at least one storage hanger comprises a grommet installed in one of the ends of said plate.

12. The fabric storage panel according to claim 9, wherein said plate has a length of about eleven and one-half inches and a width of about seven and one-half inches.

13. The fabric storage panel according to claim 9, wherein said plate has a thickness of about one-eighth of an inch.

14. A fabric storage panel, comprising:

an elongate, thin plastic plate formed of multiple cross-ply laminations of corrugated plastic material having a first end and a second end opposite the first end defining an axial length therebetween;

a pair of sides having edges parallel to the axial length;

at least one storage hanger disposed in at least one of the ends of said plate; and a plurality of laterally spaced fabric sheet gripping tabs disposed along the axial length;

said tabs for gripping a leading edge of a sheet of fabric parallel to the axial length of the panel so that the fabric may be wrapped around the axial length of the panel for storage.

15. A method of storing a sheet of fabric material on the fabric storage panel of claim 14, comprising the steps of:

(a) folding the sheet of fabric material lengthwise as required to have a width no greater than a width of the plate;

(b) removably gripping one end of the folded sheet of fabric material to the plate; and (c) winding the folded sheet of fabric material about the width of the plate until the fabric material has been completely wound about the plate.

* * * * *